US011477861B2

(12) United States Patent
Mironov et al.

(10) Patent No.: US 11,477,861 B2
(45) Date of Patent: Oct. 18, 2022

(54) AEROSOL-GENERATING ARTICLE, DEVICE AND SYSTEM FOR USE WITH A PLURALITY OF AEROSOL-FORMING SUBSTRATES

(71) Applicant: PHILIP MORRIS PRODUCTS S.A., Neuchatel (CH)

(72) Inventors: Oleg Mironov, Cudrefin (CH); Jerome Christian Courbat, Neuchatel (CH); Michael Paton, Royston (GB); David Cross, Letchworth (GB); Enrico Stura, Palezieux-Village (CH)

(73) Assignee: Philip Morris Products S.A., Neuchatel (CH)

( * ) Notice: Subject to any disclaimer, the term of this patent is extended or adjusted under 35 U.S.C. 154(b) by 80 days.

(21) Appl. No.: 16/611,241

(22) PCT Filed: May 9, 2018

(86) PCT No.: PCT/EP2018/061946
§ 371 (c)(1),
(2) Date: Nov. 6, 2019

(87) PCT Pub. No.: WO2018/206616
PCT Pub. Date: Nov. 15, 2018

(65) Prior Publication Data

US 2020/0060348 A1 Feb. 27, 2020

(30) Foreign Application Priority Data

May 10, 2017 (EP) ..... 17170414

(51) Int. Cl.
*H05B 6/10* (2006.01)
*A24F 40/30* (2020.01)
(Continued)

(52) U.S. Cl.
CPC ..... *H05B 6/108* (2013.01); *A24F 40/30* (2020.01); *A24F 40/42* (2020.01); *A24F 40/46* (2020.01);
(Continued)

(58) Field of Classification Search
CPC ..... A24F 47/00
(Continued)

(56) References Cited

U.S. PATENT DOCUMENTS 5,613,505 A 3/1997 Campbell
11,013,872 B2 5/2021 Silvestrini
(Continued)

FOREIGN PATENT DOCUMENTS

CN 105792688 7/2016
CN 106455708 2/2017
(Continued)

OTHER PUBLICATIONS

Office Action issued in Europe for Application No. 18724208.6 dated Jan. 11, 2021 (4 pages).
(Continued)

*Primary Examiner* — Phuong K Dinh
(74) *Attorney, Agent, or Firm* — Mueting Raasch Group

(57) ABSTRACT

An aerosol-generating device includes a receiving sleeve which in turn includes an inner receiving zone for receiving a first aerosol-forming substrate, and an outer receiving zone extending across at least a portion of an outer circumferential periphery of the receiving sleeve for receiving a second aerosol-forming substrate. The device includes a heater for heating the first aerosol-forming substrate or the second aerosol-forming substrate.

15 Claims, 4 Drawing Sheets

(51) Int. Cl.

| | |
|---|---|
| ***A24F 40/42*** | (2020.01) |
| ***A24F 40/46*** | (2020.01) |
| ***A24F 40/465*** | (2020.01) |
| ***A24F 40/50*** | (2020.01) |
| *A24F 40/10* | (2020.01) |
| *A24F 40/20* | (2020.01) |

(52) U.S. Cl.
CPC ..... *A24F 40/465* (2020.01); *A24F 40/50* (2020.01); *A24F 40/10* (2020.01); *A24F 40/20* (2020.01)

(58) Field of Classification Search
USPC ..... 131/328–329
See application file for complete search history.

(56) References Cited

U.S. PATENT DOCUMENTS

| | | | | |
|---|---|---|---|---|
| 2013/0037041 | A1 | 2/2013 | Worm | |
| 2014/0000638 | A1 | 1/2014 | Sebastian | |
| 2014/0166029 | A1 | 6/2014 | Weigensberg | |
| 2015/0272225 | A1 | 1/2015 | Worm | |
| 2015/0136154 | A1 | 5/2015 | Mitrev | |
| 2017/0027232 | A1 | 2/2017 | Scheck | |
| 2017/0027233 | A1 | 2/2017 | Mironov | |
| 2017/0042243 | A1 | 2/2017 | Plojoux | |
| 2017/0055583 | A1* | 3/2017 | Blandino | H05B 6/06 |
| 2017/0071250 | A1 | 3/2017 | Mironov | |
| 2018/0132531 | A1* | 5/2018 | Sur | A61M 11/042 |

FOREIGN PATENT DOCUMENTS

| | | |
|---|---|---|
| JP | 2017500848 | 1/2017 |
| RU | 2600912 | 10/2016 |
| WO | WO 2014/147114 | 9/2014 |
| WO | WO 2015/147114 | 3/2015 |
| WO | WO 2015/177043 | 11/2015 |
| WO | WO 2016062777 | 4/2016 |
| WO | WO 2016156510 | 10/2016 |
| WO | WO 2017/029269 | 2/2017 |
| WO | WO 2017/068098 | 4/2017 |

OTHER PUBLICATIONS

PCT Search Report and Written Opinion for PCT/EP2018/061946 dated Jul. 3, 2018 (10 pages).
International Preliminary Report on Patentability for PCT/EP2018/061946 dated Sep. 10, 2019 (13 pages).
Office Action issued in Russia for Application No. 2019138679/03 dated Sep. 17, 2021 (12 pages). English translation included.
Office Action issued in China for Application No. 201880028487.0 dated Feb. 17, 2022 (11 pages). English translation included.
Office Action issued in Japan for Application No. 2019-561827 dated Jun. 27, 2022 (5 pages). English translation included.

* cited by examiner

AEROSOL-GENERATING ARTICLE, DEVICE AND SYSTEM FOR USE WITH A PLURALITY OF AEROSOL-FORMING SUBSTRATES

The present invention relates to an aerosol-generating device for use with a plurality of aerosol-forming substrates, an aerosol-generating article for use with such a device and an aerosol-generating system comprising such a device and such an article.

Aerosol-generating systems comprising an electrically driven aerosol-generating device and a compatible aerosol-generating article are generally known form prior art. The article includes an aerosol-forming substrate that is capable of releasing volatile substances to form an inhalable aerosol therefrom. Typically, the volatile substances are evaporated from the substrate upon heating. For this, the article is inserted into the aerosol-generating device, for example into a receiving chamber, such as to be operatively coupled with an electrical heater of the device. The heater may be a resistive heater or an inductive heater. Some systems also provide evaporation of a plurality of aerosol-forming substrates, for example a combination of liquid and solid aerosol-forming substrates.

US 2015/272225 A1 discloses an aerosol-generating device for use with an aerosol-generating article that includes a tubular aerosol-forming substrate body to be heated by the device. The device comprises a cylindrical receiving protrusion having a resistive tubular heating member arranged on its outer surface. The protrusion is configured to be inserted into a cylindrical inner void of the article defined by the tubular substrate body. The latter comprises different substrate segments associated with individual heating elements of the heating member that are arranged at different axial positions along the length extension of the protrusion. Upon attaching the article to the device, the tubular substrate body surrounds the tubular heating member such that each of the heating elements is in contact with a respective segment of the surrounding substrate body.

Yet, there is a need for aerosol-generating systems using a plurality of aerosol-forming substrates which are more compact and which preferably also provide a user with more possibilities in using different substrates.

According to the invention there is provided an aerosol-generating device for use with a plurality of aerosol-forming substrates. The device comprises a receiving sleeve. The receiving sleeve comprises an inner receiving zone within the receiving sleeve for receiving at least a first aerosol-forming substrate, and an outer receiving zone extending across at least a portion of an outer periphery of the receiving sleeve for receiving at least a second aerosol-forming substrate. Furthermore, the device comprises an electrical heater for heating at least the first aerosol-forming substrate or the second aerosol-forming substrate when being received in the first and second receiving zone, respectively.

As used herein, the term 'aerosol-generating device' is used to describe a device that interacts with at least one, preferably two aerosol-forming substrates of an aerosol-generating article for generating an aerosol. Preferably, the aerosol-generating device is a puffing device for generating an aerosol that is directly inhalable by a user thorough the user's mouth. Most preferably, the aerosol-generating device is configured for use with, that is, is compatible with an aerosol-generating article according to the present invention and as described herein.

Due to the at least two receiving zones, the aerosol-generating device according to the invention allows at least two, preferably different aerosol-forming substrates to be received in the device at the same and thus to be in a state ready to be used without any further preparation of the device. In particular, having an inner receiving zone within the receiving sleeve and an outer receiving zone in the outer circumferential periphery of the receiving sleeve provides an at least partially nested arrangement of the inner and the outer receiving zone. In this nested arrangement the inner receiving zone is at least partially arranged within and surrounded by the outer receiving zone which proves advantageous with regard to a compact and simple design of the aerosol-generating device. In particular, a nested arrangement of at least two receiving zones provides an aerosol-generating device having a high volumetric receiving capacity for aerosol-forming substrate within a given outer cross-sectional profile of the aerosol-generating device. In addition, the receiving sleeve provides a physical partition between the inner and the outer receiving zone. Thus, the first and second aerosol-forming substrate are physically separated which facilitates to selectively or solely consume only one of the two substrates.

Of course, the aerosol-generating device may comprise more than two receiving zones, that is, at least one further receiving zone in addition to the inner and the outer receiving zone. Moreover, at least one of the inner receiving zone or the outer receiving zone or the at least one further receiving zone may be configured for receiving a plurality of aerosol-forming substrates, in particular a plurality of different aerosol-forming substrates, for example two different aerosol-forming substrates.

The inner receiving zone may extend axially along least a portion of the axial length extension of the receiving sleeve. Likewise, the inner receiving zone may extend radially with regard to the longitudinal axis of the receiving sleeve across at least a portion of an inner cross-sectional area of the receiving sleeve. In particular, the inner receiving zone may extend across the entire interior volume of the receiving sleeve. Advantageously, this provides a maximum receiving capacity for the first aerosol-forming substrate. Preferably, the first receiving zone is rod-shaped, in particular cylindrical.

The outer receiving zone may extend axially also along least a portion of the axial length extension of the receiving sleeve. Radially with regard to the longitudinal axis of the receiving sleeve, the outer receiving zone may extend across at least a portion of a cross-sectional area between an outer cross-sectional profile of the receiving sleeve and a maximum outer cross-sectional profile of the overall aerosol-generating device. Advantageously, this provides a maximum receiving capacity for the second aerosol-forming substrate. Preferably, the second receiving zone is of a sleeve shape or a tubular shape, in particular of a hollow cylindrical shape.

As stated above, the inner receiving zone and the outer receiving zone preferably overlap or are nested at least partially along a longitudinal axis of the receiving sleeve. Preferably, the outer receiving zone entirely surrounds the inner receiving zone, in particular along the entire length extension of the inner receiving zone. Moreover, the inner receiving zone and the outer receiving zone preferably are coaxial to each other with regard to a longitudinal axis of the receiving sleeve. Advantageously, all these aspects facilitate a compact design of the aerosol-generating device.

The receiving sleeve is open-ended or accessible at least at one end allowing for readily receiving the first aerosol-forming substrate within the inner receiving zone. The at least one open end or accessible end of the receiving sleeve is preferably located at a proximal end of the aerosol-generating device. In particular, the receiving sleeve may protrude at a proximal end of the aerosol-generating device.

The receiving sleeve preferably extends coaxially to a longitudinal axis of the aerosol-generating device. That is, a longitudinal axis of receiving sleeve may be coaxial to a longitudinal axis of the aerosol-generating device.

The receiving sleeve may have a circumferential sleeve wall that is completely closed. Advantageously, this provides a maximum separation of the first and second receiving zone. Alternatively, the receiving sleeve may have a circumferential sleeve wall that is at partially open. For example, the receiving sleeve may comprise one or more circumferential or axial slits extending along a circumferential direction or an axial direction with regard to a length axis of the receiving sleeve, respectively. In particular, the receiving sleeve may comprise two or more sleeve segments circumferentially arranged next to each.

The receiving sleeve may have a cross-section of any shape, for example an annular oval or elliptical or circular or square or rectangular or triangular or polygonal cross-section. Moreover, an inner cross-sectional profile of the receiving sleeve may either have the same shape as or a shape different from a shape of an outer cross-sectional profile of the receiving sleeve. Likewise, either one of the inner cross-sectional profile or the outer cross-sectional profile of the receiving sleeve may be of any shape, for example oval or elliptical or circular or square or rectangular or triangular or polygonal.

An inner cross-sectional profile and an outer cross-sectional profile of the receiving sleeve may be rotationally symmetric with regard to a longitudinal axis of the receiving sleeve. Advantageously, this enables a user to readily insert the first and second aerosol-forming substrates in any rotational position.

In particular, the receiving sleeve may be of cylindrical shape. A cylindrical shape has a constant cross-section along a longitudinal axis of the receiving sleeve, that is, along the cylinder axis. Advantageously, this allows for smoothly receiving the first and the second aerosol-forming substrate in the inner and outer receiving zones, respectively.

Alternatively, at least one of an inner cross-sectional profile or an outer cross-sectional profile of the receiving sleeve may decrease along a longitudinal axis of the receiving sleeve towards an open end or proximal end of the receiving sleeve. Having at least one of a tapered inner or outer cross-sectional profile advantageously facilitates insertion of the first and second aerosol-forming substrate into the inner and outer receiving zones, respectively. In particular, the tapered shaped provides a centering guide as well as an end stop when introducing the first and the aerosol-forming substrates into the aerosol-generating device. Accordingly, the inner receiving zone may be conical or frustum-like. Likewise, the outer receiving zone may be of a conical ring shape.

According to the invention, the electrical heater is configured for heating at least the first aerosol-forming substrate or at least the second aerosol-forming substrate when being received in the first or second receiving zone, respectively. That is, the heater may allow for at least one of heating the first aerosol-forming substrate, heating the second aerosol-forming substrate, or heating both, the first and the second aerosol-forming substrate. In case the heater is configured to heat only one of the first or the second aerosol-forming substrate, the respective non-heated aerosol-forming substrate may nevertheless contribute to the user experience. For example, the non-heated aerosol-forming substrate may comprises volatile substances which are readily released at ambient temperatures or which continually flow or are drawn into the respective other (heated) aerosol-forming substrate or into a flow of substances evaporated from the respective other (heated) aerosol-forming substrate.

Preferably, the electrical heater is configured for selectively heating at least one of the first aerosol-forming substrate or the second aerosol-forming substrate. In particular, the electrical heater may be configured for heating each one of the first and the second aerosol-forming substrate individually. That is, the electrical heater may be configured for heating only one of the first or the second aerosol-forming substrate at a time, or for simultaneously heating both, the first and the second aerosol-forming substrate, at the same time. In the latter case, the electrical heater may be especially configured for heating each one of the first and the second aerosol-forming substrate individually at the same time. Likewise, the electrical heater may be configured for heating the first and second aerosol-forming substrate subsequently or alternatingly.

Moreover, the electrical heater may be configured for heating the first and second aerosol-forming substrate differently, in particular with different heating powers, for different heating periods, and/or in different heating modes, such as in a pulsed or a continuous heating mode.

Due to this selective heatability of the first and second aerosol-forming substrate, the aerosol-generating device advantageously enables a user to selectively consume either one of the first or the second substrate or a combination of both substrates at the same time which greatly enhances the user experience. Furthermore, allowing two aerosol-forming substrates to be consumed either simultaneously or successively or alternatingly enables a user to vary, in particular to significantly extend the duration of a user experience.

Of course, the electrical heater may be configured for heating one or more further aerosol-forming substrates, if present. In particular, the electrical heater may be configured for heating at least the first aerosol-forming substrate, the second aerosol-forming substrate or at least one further aerosol-forming substrate. Moreover, the electrical heater is configured for selectively heating at least one of the first aerosol-forming substrate or the second aerosol-forming substrate or at least one further aerosol-forming substrate.

According to one aspect of the invention, the electrical heater may be resistive heater. The resistive heater may comprise at least one of a first resistive heating element for heating the first aerosol-forming substrate and a second resistive heating element for heating the second aerosol-forming substrate. For this, the first and the second heating element preferably are arranged close to or in the inner and outer receiving zone, respectively. Thus, upon receiving the first and second aerosol-forming substrate, the first and second resistive heating elements are in close proximity or in physical contact with the first and second aerosol-forming substrate, respectively. Each of the first and second resistive heating elements may comprise an electrically resistive material configured to heat up when an electrical current is passed therethrough. Advantageously, the electrically resistive material is a material having a defined relationship between temperature and resistivity. In particular, this allows for temperature measurement and temperature control. Preferably, the electrically resistive material is a metal, such as platinum or stainless steel or nickel or copper. Nickel and copper are particularly suitable for moderate operation temperatures. Furthermore, nickel and copper have a high temperature coefficient of resistance which makes these materials particularly suitable for temperature control. Preferably, each of the first and second resistive heating elements is operatively coupled to a power supply of the aerosol-generating device providing the electrical current to be passed through the respective heating element. For controlling the heating process, the aerosol-generating device may further comprise an electrical circuitry which preferably is operatively connected to the power supply and the first and second resistive heating element, if present. Each of the first and second resistive heating elements may comprise a variety of configurations. In particular, the first resistive heating element or the second resistive heating element or both, the first and the second resistive heating elements, may be for example of a fiber, or mesh-like or blade-like or pin-like configuration. Preferably, the first resistive heating element is a resistive heating blade which may be configured for insertion into the first aerosol-forming substrate when being received in the inner receiving zone. The resistive heating blade may for example comprise an electrically resistive metal track on a surface of a blade body. The blade body may be made of a ceramic material or a metal. Furthermore, the surface of the blade body may be coated by a preferably electrically non-conductive coating, in particular in case the blade body is made of an electrically conductive material. In that case, the metal track is arranged on the coated surfaces.

Instead of being integral part of the aerosol-generating device, at least one of the first or the second heating element may be integral part of an aerosol-generating article comprising the first and second aerosol-forming substrate to be used with the device. In this case, the aerosol-generating device may comprise at least one docking connector. The docking connector is configured for operatively coupling at least one of the first or second resistive heating elements with the power supply upon insertion of the article into the receiving chamber of the device.

According to another aspect of the invention, the electrical heater may be an inductive heater. In general, inductive heating is based on heating a susceptor by means of an alternating electromagnetic field due to heat generating eddy currents and/or hysteresis losses induced by the field in the susceptor depending on the electrical and magnetic properties of the susceptor material. When placed in thermal proximity of or even in direct contact with an aerosol-forming substrate, the susceptor may be used for heating the substrate such as to releases volatile compounds that can form an aerosol. Advantageously, inductive heating does not require any wiring of the susceptor and thus allows for contactless heating of the susceptor.

In general, the electromagnetic field used to heat up the susceptor is provided by an induction source comprising an inductor coil which emits the alternating electromagnetic field upon running an alternating current therethrough. For this, the induction source may further comprise an alternating current (AC) generator that is operatively coupled to the inductor coil. With regard to the present invention, the inductive heater preferably comprises two, in particular independent induction sources, that is, a first induction source and a second induction source. Having two, in particular independent, induction sources proves advantageous for heating the first and the second aerosol-forming substrate selectively.

Accordingly, the inductive heater preferably comprises at least one of a first inductor coil or a second inductor coil, being associated to the first and the second aerosol-forming substrate, respectively. In case of two inductor coils, the first and the second inductor coil may be physically separate from each other. Alternatively, the first and the second inductor coils may be a first and a second segment of a single master inductor coil.

The aerosol-generating device may also comprise at least one of a respective first or second susceptor to interact with first and second inductor coil. If part of the device, the first susceptor preferably is arranged within or close to the inner receiving zone, in particular in close proximity to the first inductor coil. Preferably, the first susceptor is a susceptor blade, which may be configured for insertion into the first aerosol-forming substrate when being received in the inner receiving zone. Likewise, if part of the device, the second susceptor preferably is arranged within or close to the outer receiving zone, in particular in close proximity to the second inductor coil. Advantageously, this enhances the heating efficiency. Upon receiving the first and second aerosol-forming substrate, the first and second susceptor preferably are in close proximity or even in contact with the first and second aerosol-forming substrate, respectively.

Yet, according to a preferred aspect of the invention at least one of the first or the second susceptor, preferably both susceptors are not integral part of the device but integral part an aerosol-generating article comprising the first and second aerosol-forming substrate to be used with the device.

Preferably, the first and the second inductor coils are configured to be operated at different operation frequencies. Advantageously, operating the first and the second inductor coils at different operation frequencies further facilitates heating the first and the second aerosol-forming substrate selectively.

The inductive heater preferably comprises at least one a first and a second AC generator. The first AC generator is operatively coupled to the first inductor coil. The second AC generator is operatively coupled to the second inductor coil. This proves particularly advantageous for heating the first and the second aerosol-forming substrate selectively.

Alternatively, the inductive heater may comprise a master induction source including a master AC generator for operating both, the first and the second induction coil. In this case, the master induction source may comprise a switching circuitry for operating the first and second inductor coil selectively.

Each one of the first, the second or the master AC generator may be operatively coupled to a power supply of the aerosol-generating device. Each one of the first, the second or the master AC generator may further comprise a DC/AC inverter, which may include a Class-D or Class-E power amplifier. In particular, each one of the first, the second or the master AC generator may be configured to generate an alternating, in particular high frequency current to be passed through the respective inductor coil. As used herein, a high frequency current means an oscillating current having a frequency between 500 kHz and 30 MHz, preferably between 1 MHz and 10 MHz and more preferably between 5 MHz and 7 MHz.

To reduce any interference effects between the inductive heating of the first and the second aerosol-forming substrate, the first inductor coil and the second inductor coil are preferably arranged at different axial positions with regard to a longitudinal axis of the receiving sleeve.

Furthermore, at least one the first inductor coil or the second inductor coil may be arranged on an inner circumferential surface of the receiving sleeve or on an outer circumferential surface of the receiving sleeve or between an inner and an outer circumferential surface of the receiving sleeve. Preferably both, the first inductor coil and the second inductor coil, are arranged between an inner and an outer circumferential surface of the receiving sleeve, in particular within a circumferential wall of the receiving sleeve. This proves advantageous with regard to a compact simple design of the aerosol-generating device. Having the inductor coils between an inner and an outer circumferential surface of the receiving sleeve also avoids exposure of the coils to generated aerosol so that deposits on the coil and possible corrosion can be advantageously prevented.

Yet further, at least one of the first inductor coil or the second inductor coil is a helical inductor coil or a flat inductor coil, in particular a flat spiral inductor coil.

The use of helical coils allows for generating homogenous fields which may prove advantageous with regard to a homogenous heating process. As used herein, the term 'helical inductor coil' does not only include helical inductor coils having a circular cross-section but also other closed-line cross-sections, in particular an oval or elliptical or square or rectangular or triangular or polygonal cross-section. Advantageously, the cross-section of the helical inductor coil corresponds to the cross-section of the receiving sleeve. According to a preferred aspect of the invention, the first inductor coil and the second inductor coil are both helical inductor coils arranged coaxially between an inner and an outer circumferential surface of the receiving sleeve at different axial positions with regard to the longitudinal axis of the receiving sleeve. In this configuration, each one of the first and the second inductor coil may generate an alternating electromagnetic field inside and outside the receiving sleeve having magnetic field lines which are substantially parallel to the longitudinal axis of the receiving sleeve.

The use of a flat inductor coil, in particular a flat spiral inductor coil, advantageously facilitates a compact design of the device. The term 'flat spiral inductor coil' as used herein covers spiral inductor coils that are planar as well as spiral inductor coils hat are shaped to conform to a curved surface. The flat spiral inductor coil may have a circular shape or may have a generally oblong or rectangular shape. According to another preferred aspect of the invention, the first inductor coil and the second inductor coil are both curved flat spiral inductor coils arranged between an inner and an outer circumferential surface of the receiving sleeve at different axial positions with regard to the longitudinal axis of the receiving sleeve. In this configuration, each one of the first and the second inductor coil may generate an alternating electromagnetic field having magnetic field lines which are substantially orthogonal to the inner and an outer circumferential surface of the receiving sleeve.

Preferably, at least one the first inductor coil or the second inductor coil may be covered by a corrosion resistant coating or enclosure.

According to another aspect of the invention, the electrical heater may be a combined resistive and inductive heater, that is, a hybrid heater. The hybrid heater comprises a resistive heater for heating one of the first or the second aerosol-forming substrate and an inductive heater for heating the respective other one of the first or the second aerosol-forming substrate. In particular, the hybrid heater may be configured for selectively heating at least one of the first or the second aerosol-generating system. As described above, the electrical heater preferably comprises a resistive heating element which comprises an electrically resistive material configured to heat up when an electrical current is passed therethrough. As further described above, the induction heater preferably comprises an induction source including an inductor coil and an AC generator. The induction heater may also comprise a susceptor as integral part of the device. Alternatively, the susceptor may be integral part of an aerosol-generating article to be used with the aerosol-generating device comprising the hybrid heater. Further features and advantageous of the resistive heater and the inductive heater have been described above and will not be repeated.

Preferably, the hybrid heater comprises a resistive heater for heating the first aerosol-forming substrate within the inner receiving zone and an inductive heater for heating the second aerosol-forming substrate within the outer receiving zone. As regards heating of the first aerosol-forming substrate within the inner receiving zone, the resistive heater comprises a resistive heating element which preferably is a resistive heating blade as described above. As regards heating of the second aerosol-forming substrate within the outer receiving zone, the inductive heater comprises an inductor coil which preferably is arranged on an outer circumferential surface of the receiving sleeve or between an inner and an outer circumferential surface of the receiving sleeve.

According to a further aspect of the invention, the aerosol-generating device may comprise a first airflow passage passing through the inner receiving zone and a second airflow passage passing through the outer receiving zone. Thus, volatile substances vaporized from the first and the second aerosol-forming substrate upon heating may be directly entrained in an airflow through the first and the second airflow passage, respectively, such as to subsequently cool down to form an aerosol.

The aerosol-generating device may comprise separate air inlets for the first airflow passage and the second air flow passage, that is, at least one first air inlet and at least one second air inlet. Alternatively, the device may comprise at least one common air inlet from which the first and the second airflow passages branch off. Likewise, the device may comprise separate air outlets for the first airflow passage and the second air flow passage, that is, at least one first air outlet and at least one second air outlet. Alternatively, the device may comprise at least one common air outlet which the first and the second airflow passage are in fluid communication with.

The device may further comprise an electric circuitry for controlling the operation of the device, in particular the heating process. The electric circuitry may also include at least parts the electrical heater, that is, parts of the resistive heater or the inductive heater or the hybrid heater. In particular, the electric circuitry may include at least parts of the first and second induction source or the common induction source, preferably the first and the AC generator or the common AC generator. The electric circuitry may comprise a microprocessor, a microcontroller, or other electronic circuitry capable of providing control. In particular, the electric circuitry may be configured to regulate a supply of current to the inductor coil(s) or the resistive heating element(s). Current may be supplied to the inductor coil(s) and/or the resistive heating element(s) continuously following activation of the system or may be supplied intermittently, such as on a puff by puff basis.

The aerosol-generating device may comprise a power supply, operatively connected to the respective induction sources and the electric circuitry. Preferably, the power supply is a battery such as a lithium iron phosphate battery. Alternatively, the power supply may be another form of charge storage device such as a capacitor. The power supply may require recharging and may have a capacity that allows for the storage of enough energy for one or more user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the inductor coil.

The device may comprise a device body, in particular a main device body. Preferably, the device body includes the electrical heater, the electric circuitry and the power supply. The device body may be of an elongated shape, in particular rod-shaped or stick-shaped.

The receiving sleeve preferably is arranged coaxially along a longitudinal axis of the aerosol-generating device. In particular, a proximal end of the receiving sleeve may form a proximal end of the aerosol-generating device. As described above, the receiving sleeve is open-ended or accessible at the proximal end of the receiving sleeve.

The aerosol-generating device may further comprise a mouthpiece which may be removably attached to the device body at a proximal end of the device. When being attached to the device body, the mouthpiece and the device body may together form a device housing. In particular, the mouthpiece may surround at least a portion of the first and the second receiving zone, when being attached to the main body. As used herein, the term 'mouthpiece' means a portion of the device that is placed into a user's mouth in order to directly inhale an aerosol generated by the aerosol-generating system. Accordingly, the mouthpiece may comprise at least one air outlet through which aerosol generated by the device can be drawn out. In particular, the mouthpiece may comprise at least one first air outlet and at least one second air outlet. The at least one first air outlet may be in fluid communication with the first airflow passage passing through the inner receiving zone. Accordingly, the at least one second air outlet may be in fluid communication the second airflow passage passing through the outer receiving zone. Alternatively, the mouthpiece may comprise at least one common air outlet which the first and the second airflow passage are in fluid communication with.

The device may be configured to allow user a selection of an operation mode of the device. That is, the user may select whether to consume either one of the first or the second substrate or a combination of both substrates at the same time. The specific operation mode may be selected manually, for example by pressing an activation button.

The heating process itself may be also (de-)activated manually, for example by way of an activation button. Instead of manually (de-)activating the heating process, the device may include a puff sensor, such as a microphone, for detecting when a user puffs on the mouthpiece. The puff sensor may be part of the electric circuitry of the device. When a puff is detected, at least one of the first or the second AC generator is activated, depending on the specifically selected operation mode. The oscillating currents are applied to respective inductor coils for a predetermined duration after detection of a puff, and are then switched off until a new puff is detected. However, activation and deactivation on a puff basis preferably is only used with regard to heating a liquid aerosol-forming substrate. In contrast, solid aerosol-forming substrates typically require some heating time until reaching a temperature sufficient to vaporize the solid aerosol-forming substrate. Therefore, the heating process of a solid aerosol-forming substrate preferably is activated and deactivated manually, for example by way of the activation button.

Of course, the device may be also configured such as to combine both, manual (de-)activation and (de-)activation on a puff basis. For example, the device may be configured for manual (de-)activation of the heating process of one of the first or the second aerosol-forming substrate, and for (de-)activation on a puff basis of the heating process of the respective other one of the first or the second aerosol-forming substrate.

According to the invention there is also provided an aerosol-generating article for use with an aerosol-generating device. Preferably, the aerosol-generating article is configured for use with, that is, is compatible with an aerosol-generating device according to the present invention and as described herein. The article comprises an inner substrate core containing or being adapted for containing a first aerosol-forming substrate. The article further comprises an outer substrate sleeve containing or being adapted for containing a second aerosol-forming substrate. The outer substrate sleeve surrounds the inner substrate core at a distance such as to form a circumferential slot between the inner core and the outer sleeve. The circumferential slot is open or accessible at a distal end of the article. In particular, the circumferential slot is open or accessible at a distal end face of the inner core and the outer sleeve and thus at a distal end face of the article.

The circumferential slot between the substrate core and the substrate sleeve advantageously provides a physical separation of the first and the second aerosol-forming substrate. In use, this physical separation facilitates to selectively or solely consume only one of the two substrates.

Furthermore, the circumferential slot—being open or accessible at a distal end of the article—allows for inserting a corresponding receiving sleeve of an aerosol-generating device between the substrate core and the substrate sleeve and thus to readily engage the article with an aerosol-generating device. Upon insertion, the inner substrate core of the article is arranged within the interior, in particular within an inner receiving zone of the receiving sleeve of the device. Likewise the outer substrate sleeve of the article is arranged within the outer circumferential periphery, in particular within an outer receiving zone of the receiving sleeve of the device. In this configuration, the receiving sleeve of the device is nested with the substrate core and the substrate sleeve of the article, thus providing an aerosol-generating system having a very compact design.

As used herein, the term 'aerosol-generating article' refers to an article which either contains or is at least adapted for containing a first aerosol-forming substrate, and additionally either contains or is at least adapted for containing a second aerosol-forming substrate respectively. Due to this, the article according to the invention may be considered to be a hybrid aerosol-generating article which offers a user the experience of at least two aerosol-forming substrates.

The first and the second first aerosol-forming substrate are capable of releasing volatile compounds that can form an aerosol. Preferably, the aerosol-generating article is a heated aerosol-generating article, that is, an aerosol-generating article containing or being at least adapted for containing a first and a second first aerosol-forming substrate which are intended to be heated rather than combusted to form an aerosol. The aerosol-generating article may be a consumable, in particular a consumable to be discarded after a single use. The article may be an article, in particular a tobacco article, resembling conventional cigarettes.

The substrate core may be rod-shaped, in particular cylindrical or conical or frustum-like. In case of a conical or frustum-like shape, the substrate core is tapered towards the distal end of the aerosol-generating article. An outer cross-section profile of the substrate core may be of any shape, for example oval or elliptical or circular or square or rectangular or triangular or polygonal. Preferably, an outer cross-section profile of the substrate core is rotationally symmetric with regard to a longitudinal axis of the receiving sleeve The substrate sleeve may be of a tubular shape. Preferably, the substrate sleeve is of cylindrical shape. A cylindrical has a constant cross-section along a longitudinal axis of the receiving sleeve, that is, along the cylinder axis. Advantageously, a cylindrical shape allows for smoothly receiving the article in an aerosol-generating device. Alternatively, at least one of an inner cross-sectional profile or an outer cross-sectional profile of the substrate sleeve may decrease or increase along a longitudinal axis of the receiving sleeve towards a distal end of the substrate sleeve, that is, towards the open end of the slot. Having a tapered inner cross-sectional profile decreasing towards a distal end of the substrate sleeve advantageously facilitates insertion of the first and second aerosol-forming substrate into the inner and outer receiving zones, respectively. In particular, a tapered inner cross-sectional profile provides a centering guide as well as an end stop when introducing the first and the aerosol-forming substrates into the aerosol-generating device. In particular, the substrate sleeve may be of a conical ring shape.

The substrate sleeve may have a cross-section of any shape, for example annular or oval or elliptical or circular or square or rectangular or triangular or polygonal. Moreover, an inner cross-sectional profile of the substrate sleeve may either have the same shape as or a shape different from a shape of an outer cross-sectional profile of the substrate sleeve. Accordingly, either one of the inner cross-sectional profile or the outer cross-sectional profile of the substrate sleeve may be of any shape, for example oval or elliptical or circular or square or rectangular or triangular or polygonal. Preferably, an outer cross-sectional profile of the substrate sleeve corresponds to an outer cross-sectional profile of the aerosol-generating article. In particular, an outer circumferential surface of the substrate sleeve may form at least a portion of an outer circumferential surface of the article.

Advantageously, an inner cross-sectional profile and an outer cross-sectional profile of the receiving sleeve are rotationally symmetric with regard to a longitudinal axis of the receiving sleeve. Advantageously, this enables a user to readily insert the first and second aerosol-forming substrates in any rotational position.

Preferably, the inner cross-sectional profile of the substrate sleeve corresponds to or has the same shape as the outer cross-sectional profile of the substrate core. Advantageously, this allows for a simple design of the aerosol-generating article and further facilities a smooth insertion of the article into an aerosol-generating device. Of course, the inner cross-sectional profile of the substrate sleeve may alternatively have a shape different from a shape of the outer cross-sectional profile of the substrate core.

At least one of, preferably both, the substrate core and the substrate sleeve, may extend coaxially to a longitudinal axis of the aerosol-generating article. That is, a longitudinal axis of substrate core and the substrate sleeve, respectively, may be coaxial to a longitudinal axis of the aerosol-generating device.

Furthermore, the inner substrate core and the outer substrate sleeve may overlap or may be nested at least partially along a longitudinal axis of the substrate sleeve. Advantageously, this allows for a compact design of the aerosol-generating device. Preferably, the substrate core axially protrudes at a distal end of the article as compared to the substrate sleeve. Vice versa, the substrate sleeve may axially recessed at a distal end of the article as compared to the substrate core. Advantageously, this may provide at least one lateral (second) air inlet in fluid communication with a second airflow passage passing along or through the substrate sleeve.

Each one of the first and the second aerosol-forming substrate may be a solid or a liquid aerosol-forming substrate. In both conditions, the aerosol-forming substrate may comprise solid and/or liquid components. In particular, the aerosol-forming substrate may comprise a tobacco-containing material including volatile tobacco flavour compounds, which are released from the substrate upon heating. Thus, the aerosol-forming substrate may be a tobacco-containing aerosol-forming substrate. The tobacco-containing material may comprise loosed filled or packed tobacco, or sheets of tobacco which have been gathered or crimped. Alternatively or additionally, the aerosol-forming substrate may comprise a non-tobacco material. The aerosol-forming substrate may further comprise an aerosol former. Examples of suitable aerosol formers are glycerine and propylene glycol. The aerosol-forming substrate may also comprise other additives and ingredients, such as nicotine or flavourants, in particular tobacco flavourants. The aerosol-forming substrate may also be a paste-like material, a sachet of porous material comprising aerosol-forming substrate, or, for example, loose tobacco mixed with a gelling agent or sticky agent, which could include a common aerosol former such as glycerine, and which is compressed or molded into a plug.

According to a particular aspect of the invention, at least one of the first or the second aerosol-forming substrate is a liquid aerosol-forming substrate. With regard to this particular aspect, at least one of the substrate core or the substrate sleeve may comprise a liquid retention material or a tank containing or being adapted for containing a liquid aerosol-forming substrate. In particular, only one of the substrate core or the substrate sleeve may comprise a liquid retention material or a tank. Preferably, only the substrate sleeve comprises a liquid retention material or a tank containing or being adapted for containing a liquid aerosol-forming substrate.

As used herein, the term 'liquid retention material' refers to a high retention or high release material (HRM) for storing a liquid. The liquid retention material is configured to intrinsically retain at least a portion of the liquid, which in turn is not available for aerosolization before having left the retention. Using a liquid retention material reduces the risk of spill in case of failure or cracks of the aerosol-generating article due to the liquid aerosol-forming substrate being safely held in the retention material. Advantageously, this allows the aerosol-generating article to be leak proof.

According to another particular aspect of the invention at least one, preferably only one of the first or the second aerosol-forming substrate is a solid aerosol-forming substrate, in particular a solid tobacco-containing aerosol-forming substrate. With regard to this aspect of the invention at least one, preferably only one of the substrate core or the substrate sleeve may comprise or substantially consist of a solid aerosol-forming substrate, that is, of a solid first or a solid second aerosol-forming substrate, respectively. Most preferably, only the substrate core comprises or substantially consists of a solid first aerosol-forming substrate.

Furthermore, at least one of the substrate core or the substrate sleeve may comprise a wrapper covering at least a portion of the first or second aerosol-forming substrate, respectively. Primarily, the wrapper serves to keep the aerosol-forming substrate together and to maintain the desired cross-sectional shape of the substrate core or substrate sleeve. In particular, the wrapper may form an outer circumferential surface of the substrate core. Likewise, the wrapper may form an inner and/or an outer circumferential surface of the substrate sleeve. The wrapper may be a paper wrapper, in particular a paper wrapper made of cigarette paper. Alternatively, the wrapper may be a foil, for example made of metal or plastics. Preferably, the wrapper is fluid permeable such as to allow vaporized aerosol-forming substrate to be released from the substrate core. The wrapper may be porous. Furthermore, the wrapper may comprise at least one volatile substance to be activated and released from the wrapper upon heating. For example, the wrapper may be impregnated with a flavoring volatile substance.

Alternatively or in addition to a wrapper, at least one of the substrate core or the substrate sleeve may comprise a cover, in particular a hard cover for covering at least a portion of the first or second aerosol-forming substrate, respectively. With regard to the substrate sleeve, at least a portion of the cover of the substrate sleeve may form an outer surface of the aerosol-generating article. In particular, the cover may encapsulate a liquid aerosol-forming substrate. Thus, the cover may form a tank containing or being adapted for containing a liquid aerosol-forming substrate. Likewise, the cover may encapsulate a liquid retention material containing or being adapted for containing a liquid aerosol-forming substrate.

In addition, at least one of the substrate core or the substrate sleeve may comprise at least one of a support element, an aerosol-cooling element, or a filter element. Any one or any combination of these elements may be arranged downstream sequentially to the first or second aerosol-forming substrate, respectively. As regards the substrate core, these elements may have the same cross-sectional shape as the substrate core or the substrate sleeve, respectively. In particular, the respective first or second aerosol-forming substrate and any one or any combination of the above elements may be arranged sequentially and enveloped by a wrapper or cover.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate. The support element may comprise a hollow tubular element or hollow sleeve element. In a preferred embodiment, the support element comprises a hollow cellulose acetate tube or sleeve.

The aerosol-cooling element may be alternatively termed a heat exchanger. The aerosol-cooling element preferably has a low resistance to draw. That is, the aerosol-cooling element preferably offers a low resistance to the passage of air through the aerosol-generating article. Preferably, the aerosol-cooling element does not substantially affect the resistance to draw of the aerosol-generating article. The aerosol-cooling element may comprise a plurality of longitudinally extending channels. The plurality of longitudinally extending channels may be defined by a sheet material that has been one or more of crimped, pleated, gathered and folded to form the channels. The plurality of longitudinally extending channels may be defined by a single sheet that has been one or more of crimped, pleated, gathered and folded to form multiple channels. Alternatively, the plurality of longitudinally extending channels may be defined by multiple sheets that have been one or more of crimped, pleated, gathered and folded to form multiple channels. In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminum foil. In a preferred embodiment, the aerosol-cooling element comprises a gathered sheet of biodegradable material. For example, a gathered sheet of non-porous paper or a gathered sheet of biodegradable polymeric material, such as polylactic acid or a grade of Mater-Bi® (a commercially available family of starch based copolyesters).

The filter element may be a conventional filter element. For example, the filter element may comprise or may be made of a cellulose acetate tow.

As an example, the substrate core may comprise a rod-shaped substrate body comprising or being made of a solid first aerosol-forming substrate. The rod-shaped substrate body may be additionally surrounded by a wrapper. Likewise, the substrate sleeve may comprise a sleeve-shaped substrate body comprising or being made of a solid second aerosol-forming substrate. The sleeve-shaped substrate body may additionally comprise a wrapper or a cover on at least one of its inner or outer circumferential surface.

According to another example, the article comprises a substrate core, in particular a rod-shaped substrate core, comprising a solid first aerosol-forming substrate located at or towards a distal end of the core. Furthermore, the substrate core comprises at least one of a support element, an aerosol-cooling element, or a filter element which are arranged sequentially to the first aerosol-forming substrate downstream towards a proximal end of the substrate core. The substrate and the at least one element mentioned before are surrounded by a wrapper. The article according to this example further comprises a substrate sleeve comprising a liquid retention material or a tank containing or being adapted for containing a liquid second aerosol-forming substrate. Having both, a solid as well as a liquid aerosol-forming substrate advantageously provides a user with different kind of flavors and user experiences, either separately or simultaneously.

The aerosol-generating article may be configured for a multiple use. Accordingly, a liquid retention material or the tank comprised in the substrate core and/or the substrate sleeve may be refillable. Likewise, at least one of the first or second aerosol-forming substrate may be replaceable. Even more, at least one of the substrate core or the substrate sleeve may be replaceable, in particular detachably arranged in the article.

According to another aspect of the invention, the aerosol-generating article may only comprise a first or second aerosol-forming substrate. In that case, the substrate core or the substrate sleeve may only be a filling body for filling the volume of a first or second receiving zone of an aerosol-generating device to be used with. When received in first or second receiving zone, the respective filling body may serve to block a respective first or second airflow passage through first or second receiving zone. Advantageously, this allows for setting a pre-defined resistance to draw. Preferably, the respective filling body may be replaced may a high retention material or a solid first or second aerosol-forming substrate.

According to a preferred aspect of the invention, the aerosol-generating article is configured for inductive heating of at least one of, in particular both, the first and the second aerosol-forming substrate. Accordingly, the article may comprise a first susceptor arranged on an outer circumferential surface of the substrate core or within the substrate core. Additionally or alternatively, the article may comprise a second susceptor arranged on an inner surface of the substrate sleeve or within the substrate sleeve. Preferably, the first and the second susceptor are arranged in close proximity to or even in contact with the first and second aerosol-forming substrate, respectively.

Alternatively, at least one of the first and the second susceptor may be part of an aerosol-generating device to be used with the article. In this case, the respective susceptor is arranged in the device such that upon assembling the device with the article, the first or second susceptor is in close proximity or even in contact with the first and second aerosol-forming substrate, respectively.

As used herein, the term 'susceptor' refers an element comprising a material that is capable being inductively heated within an alternating electromagnetic field. This may be the result of at least one of hysteresis losses or eddy currents induced in the susceptor, depending on the electrical and magnetic properties of the susceptor material. Accordingly, the first or second susceptor, respectively, may comprise an electrically conductive and/or magnetic material. In particular, the first or second susceptor, respectively, may comprise an electrically conductive and paramagnetic material, such as aluminum, or an electrically conductive and ferro- or ferrimagnetic material, such as ferromagnetic stainless steel, or an electrically non-conductive and ferro- or ferrimagnetic material, such as a ferrite ceramic.

In case the article comprises a first and a second susceptor, the first susceptor and the second susceptor are preferably arranged at different axial positions with regard to a longitudinal axis of the substrate sleeve. An axial offset between the first and the second susceptor reduces interference effects between the inductive heating of the first and the second aerosol-forming substrate. For the same reason, the first and the second susceptor may be configured to be operated at different frequencies.

The first and the second susceptor may comprise a variety of configurations. In particular, the first susceptor or the second susceptor or both, the first and the second susceptor, may be of one of particulate, or filament, or fiber, or mesh-like or planar or blade-like or pin-like or wick-like or foam-like or fabric-like or wool-like configuration. As an example, at least one of the first susceptor or the second susceptor may be of particulate configuration. A particulate configuration may be primarily used in a solid aerosol-forming substrate. The particles may have an equivalent spherical diameter of 10 micrometers to 500 micrometers, in particular of 10 micrometers to 200 micrometers, preferably of 10 micrometers to 100 micrometers. The particles may be distributed throughout the aerosol-forming substrate, either homogenously or with local concentration peaks or according to a concentration gradient. As another example, at least one of the first susceptor or the second susceptor may be of a filament or mesh-like or wick-like configuration. Filament or mesh-like or wick-like structures may have advantages with regard to their manufacture, their geometrical regularity and reproducibility. In particular, mesh-like or wick-like susceptor prove advantageous with regard to heating liquid aerosol-forming substrates. According to yet another example, at least one of the first or the second susceptor may comprise an inductively heatable porous ceramic material, for example a ceramic ferrite. Advantageously, such a susceptor may be both, a storage medium for a liquid aerosol-forming substrate as well as a heating element for inductively heating the liquid held therein. According to yet another example, the first susceptor or the second susceptor or both, the first and the second susceptor, may comprise at least one blade, pin, or wick, in particular a plurality of blades, pins, or wicks.

According to another aspect of the invention, the aerosol-generating article may be configured for resistive heating of at least one of, in particular both, the first and the second aerosol-forming substrate. In this case, the respective aerosol-forming substrate to be heated resistively is preferably configured to get into contact with a respective resistive heating element of an aerosol-generating device the article is to be used with. Alternatively, the article may comprise a resistive heating element in close proximity to or in contact with the respective aerosol-forming substrate to be heated resistively. In this case, the respective resistive heating element is configured and arranged in the article such that upon assembling the device with the article, the resistive heating element is operatively coupled to a power supply of the device.

According to yet another aspect of the invention, the aerosol-generating article may be configured for hybrid heating of the first and second aerosol-forming substrate, that is for resistively heating one of the first or the second aerosol-forming substrate and inductively heating the respective other one of the first or the second aerosol-forming substrate. In this configuration, the article preferably comprises a susceptor for inductively heating either the first or the second aerosol-forming substrate, depending on which one of the first or second aerosol-forming substrate is to be heated inductively. In contrast, the respective other aerosol-forming substrate to be heated resistively preferably is configured to get into contact with a respective resistive heating element of an aerosol-generating device the article is to be used with. Alternatively, the respective susceptor may be also part of the aerosol-generating device. Likewise, the respective resistive heating element may be part of the article, in particular arranged in close proximity to or in contact with the respective aerosol-forming substrate to be heated resistively.

The article may further comprise a mouthpiece arranged at a proximal end of the article. The mouthpiece is adapted to be placed into a user's mouth in order to directly inhale an aerosol generated from at least one of the first or the second aerosol-forming substrate. The mouthpiece is attached indirectly or directly to at least one of the substrate core or the substrate sleeve. In particular, the mouthpiece may be removably attached to at least one of the substrate core or the substrate sleeve. This proves advantageous for a multiple use of the mouthpiece.

The mouthpiece may comprise at least one air outlet through which the aerosol can be drawn out. In particular, the mouthpiece may comprise at least one first air outlet and at least one second air outlet. The at least one first air outlet may be in fluid communication with a first airflow passage passing along or through the substrate core. Accordingly, the at least one second air outlet may be in fluid communication a second airflow passage passing along or through the substrate sleeve. Alternatively, the mouthpiece may comprise at least one common air outlet which a first and the second airflow passage are in fluid communication with.

The article may further comprise a support member to which at least one the substrate core, the substrate sleeve or the mouthpiece is attached to, preferably removably attached to. The latter aspect advantageously allows for a multiple use of the article.

Further features and advantages of the article according to the invention have been described with regard to aerosol-generating device according to the invention.

According to the invention there is also provided an aerosol-generating system. The system comprises an aerosol-generating device according to the invention and as described herein. The system further comprises an aerosol-generating article according to the invention and as described herein which is configured for use with the aerosol-generating device, that is, which is compatible with the aerosol-generating device.

In order to facilitate a smooth assembly of the article and the device, a cross-sectional profile of the circumferential slot of the article preferably corresponds to a cross-sectional profile of the receiving sleeve of the device such as to allow the receiving sleeve to engage into the circumferential slot.

In the assembled state, a first airflow passage thorough the inner receiving zone preferably passes through the first aerosol-forming substrate within the substrate core. Likewise a second airflow passage through the outer receiving zone preferably passes along an inner circumferential surface of the substrate sleeve. For this, an inner cross-sectional profile of the substrate sleeve of the aerosol-generating article may be larger than an outer cross-sectional profile of the receiving sleeve of the aerosol-generating device. This configuration results in a circumferential free space volume between the inner circumferential surface of the substrate sleeve and the outer circumferential surface of the receiving sleeve which the second airflow may pass through.

A length extension of the circumferential slot of the aerosol-generating article preferably is equal or larger than a length extension of the receiving sleeve of the aerosol-generating device. Due to this, the receiving sleeve may be entirely inserted into the circumferential slot which proves advantageous with regard to a compact design.

The system may be an inductively heated aerosol-generating system, in which the aerosol-generating device comprises a first and/or second inductor coil and the aerosol-generating article comprises a respective first and/or second susceptor. Preferably, the first and/or second inductor coil within the device and the respective first and/or second susceptor within the article are arranged such that upon assembling the article with the device, the first inductor coil is arranged in close proximity, in particular next to the first susceptor and the second inductor coil is arranged in close proximity, in particular next to the second susceptor. Advantageously, this enhances the heating efficiency. Preferably, a minimum distance between the first/second susceptor and the respective first/second inductor coil is below 2 mm, in particular below 1 mm, or even below 0.5 mm.

Alternatively, at least one of the first and the second susceptor may be part of the aerosol-generating. In this case, the respective susceptor preferably is arranged in the device such that upon assembling the device with the article, the first or second susceptor is in close proximity or even in contact with the first and second aerosol-forming substrate, respectively.

The system may also be a restively heated aerosol-generating system, in which the aerosol-generating device comprises resistive heater for heating at least one the first or the second aerosol-forming substrate of the article. Likewise, the system may also be a hybrid aerosol-generating system including an aerosol-generating device comprising including a hybrid heater. The hybrid heater comprises resistive heater for resistively heating one of the first or the second aerosol-forming substrate and an inductive heater for inductively heating the respective other one of the first or the second aerosol-forming substrate.

Further features and advantages of the system according to the invention have been described with regard to aerosol-generating device and the aerosol-generating article according to the invention.

The invention will be further described, by way of example only, with reference to the accompanying drawings, in which.

Figure 1:
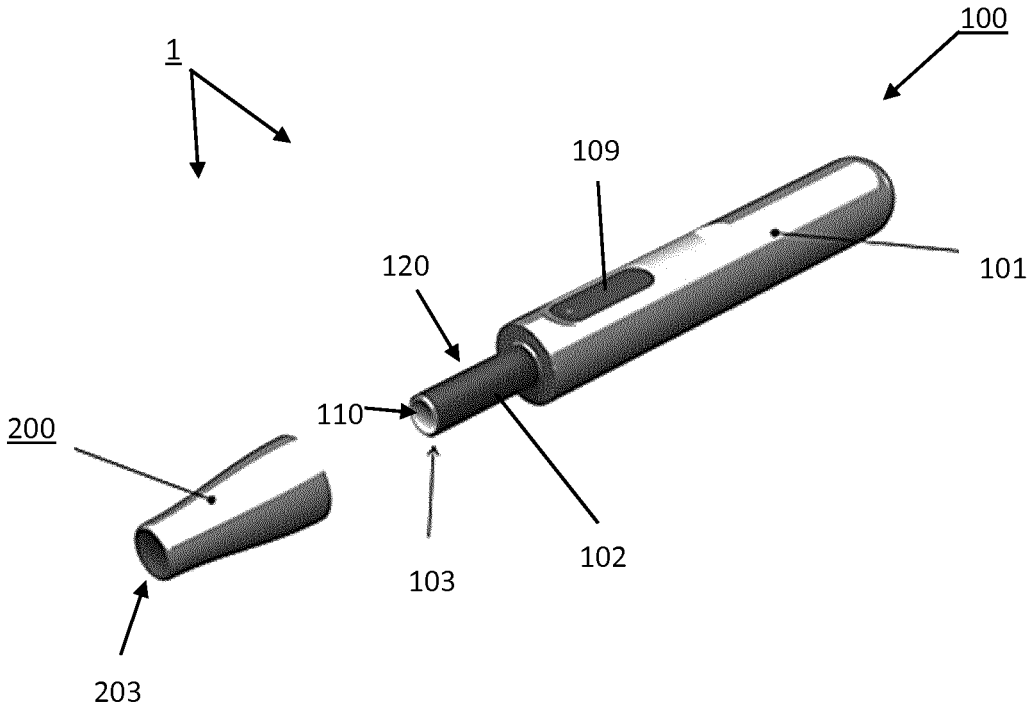
FIG. 1 is a perspective view of a first embodiment of an aerosol-generating system according to the invention, comprising an aerosol-generating device and an aerosol-generating article according to a first embodiment of the invention.
Figure 2:
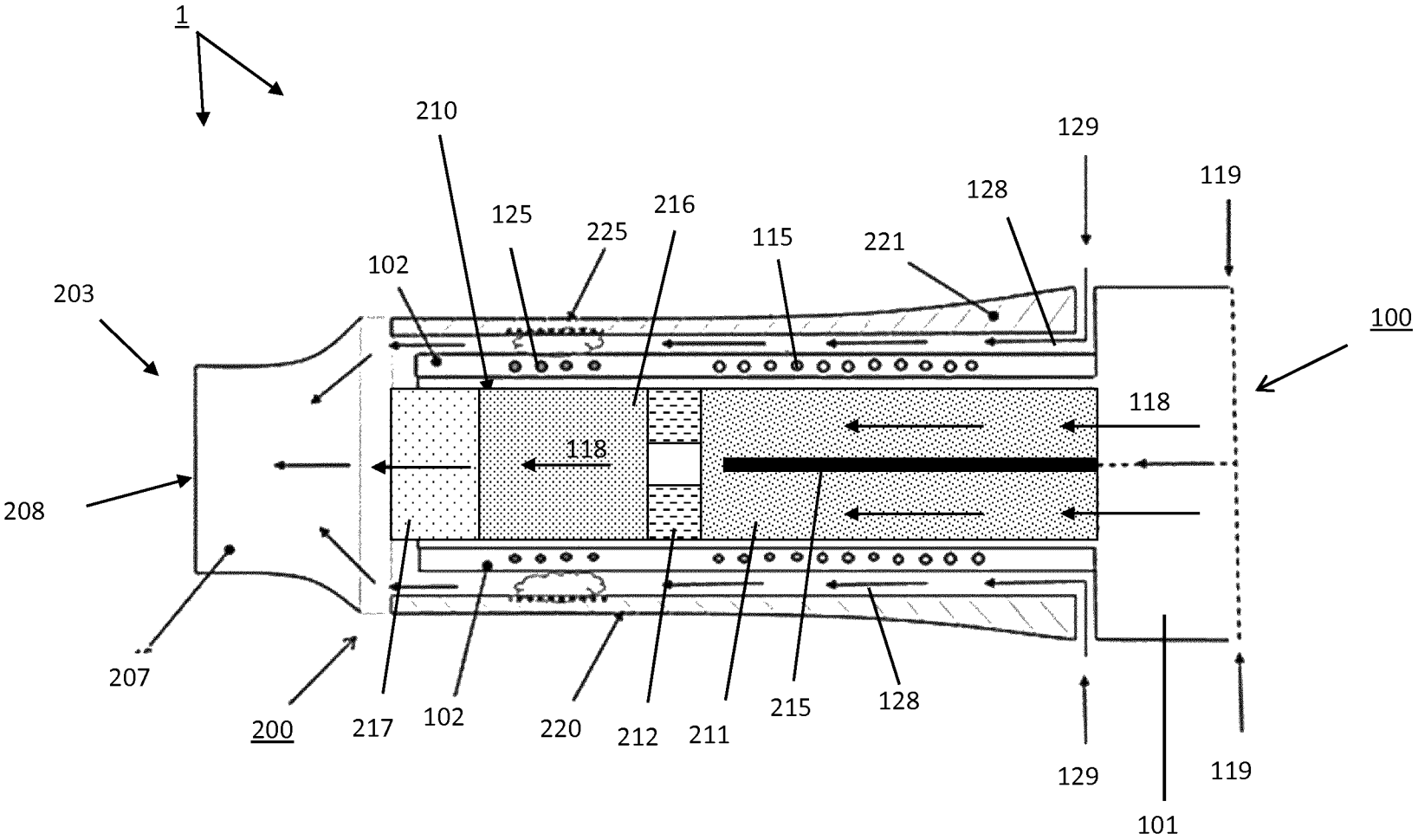
FIG. 2 is a cross-sectional view of a second embodiment of an aerosol-generating system according to the invention, comprising an aerosol-generating device and an aerosol-generating article according to a second embodiment of the invention.
Figure 3:
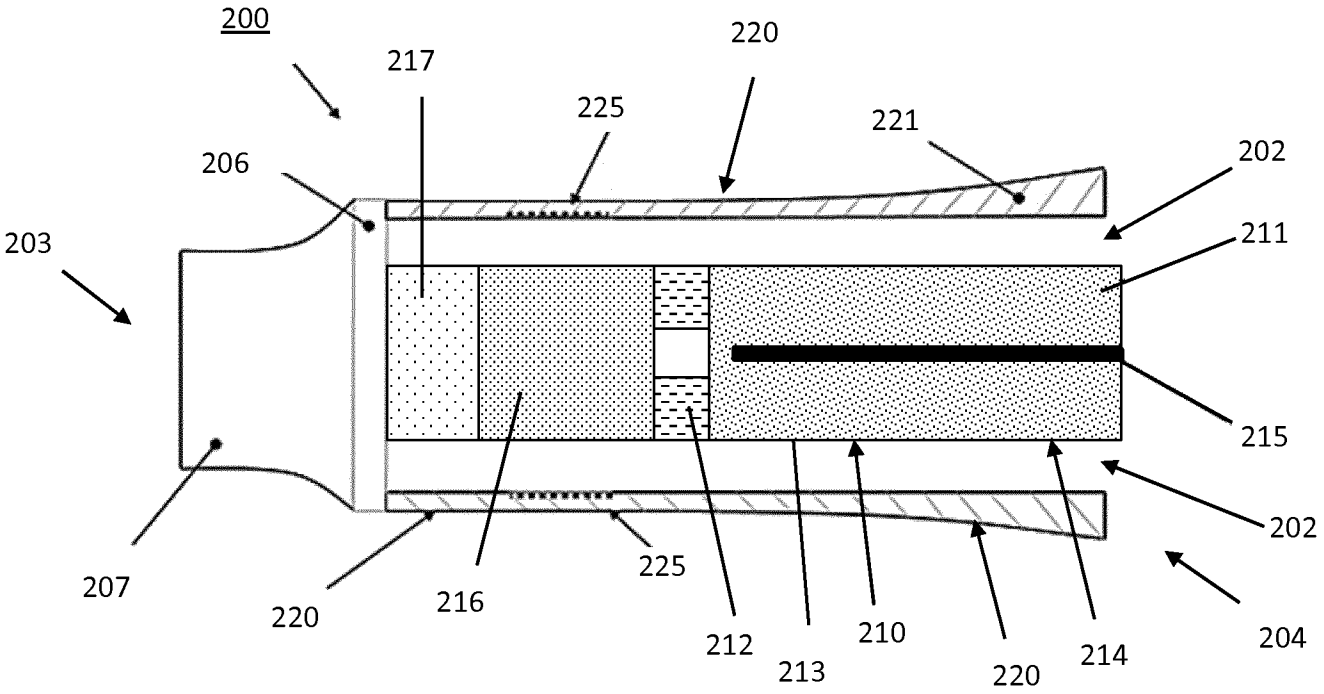
FIG. 3 is a cross-sectional view of the aerosol-generating article according to FIG. 2.
Figure 4:
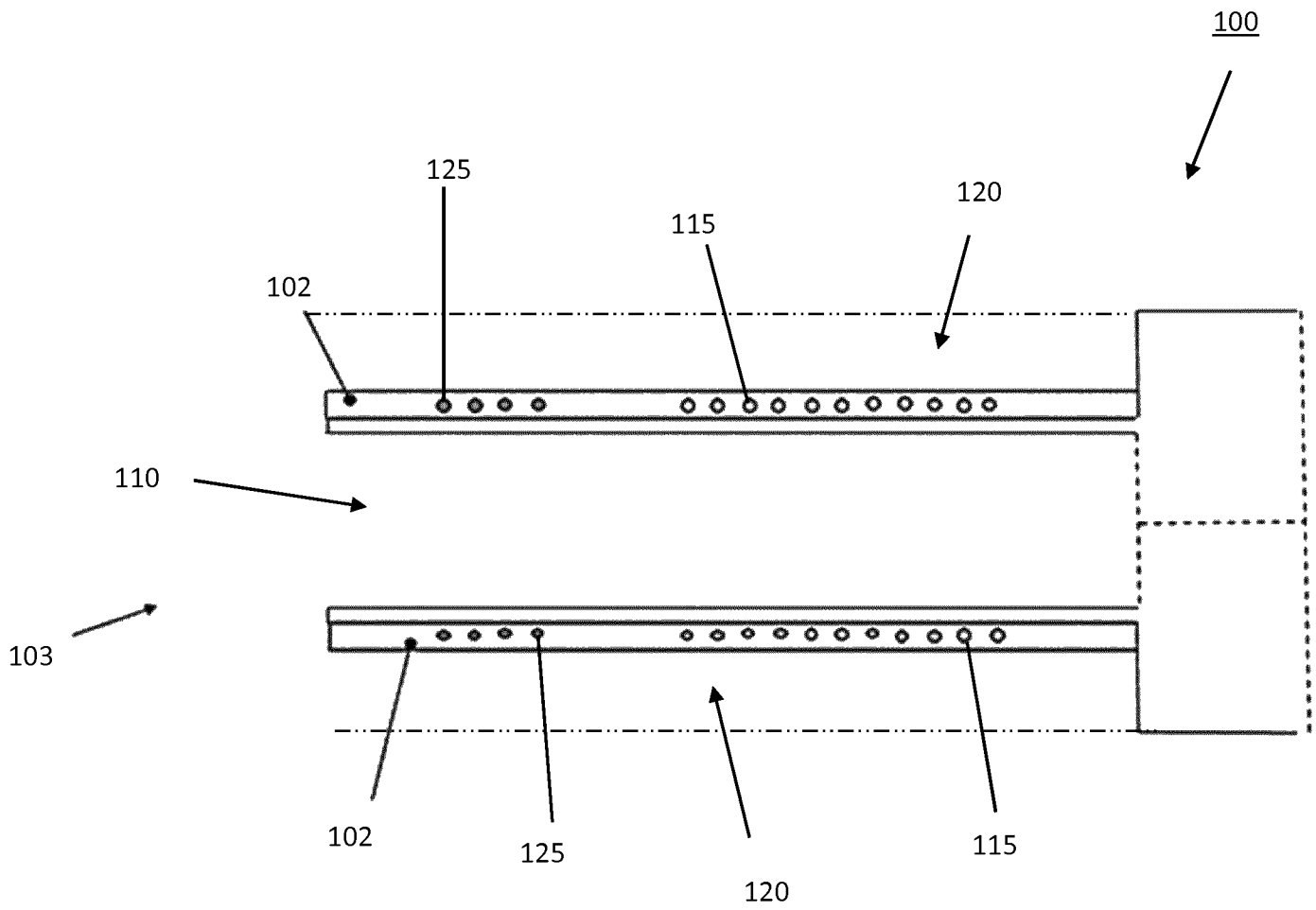
FIG. 4 is a cross-sectional view of a portion of the aerosol-generating device according to FIG. 2.

FIG. 1 and FIG. 2 illustrate a first and a second exemplary embodiment of an aerosol-generating system 1 according to the invention. In principle, the first and the second embodiment are very similar to each other. Therefore, both embodiments are described below in parallel using identical reference numbers for identical or similar features. Differences between the first and the second embodiment are only mentioned where necessary. Furthermore, it is to be noted that FIG. 1 is intended to primarily provide an overview of the aerosol-generating system and its components in general by way of the first embodiment. In contrast, FIG. 2 and related FIG. 3 and FIG. 4 provide details of the aerosol-generating system and its components by way of the second embodiment.

With reference to the first and the second embodiment as shown in FIG. 1 and FIGS. 2 to 4, respectively, the aerosol-generating system 1 according to the invention comprises two components: an aerosol-generating device 100 as well as an aerosol-generating article 200 for use with the device 100. According to the invention, the system 1 is a hybrid aerosol-generating system offering a user the experience of at least two aerosol-forming substrates. For this, the aerosol-generating article 200 according to both embodiments comprises a first and a second aerosol-forming substrate 211, 221. Likewise, the aerosol-generating device 100 comprises a corresponding first and second receiving zone 110, 120 for receiving the first and second aerosol-forming substrate 211, 221, respectively.

The aerosol-generating device 100 according to both embodiments is an electrically driven aerosol-generating device 100 configured for thermally generating an aerosol by inductively heating at least one of the first or the second aerosol-forming substrates 211, 221. The device 100 comprises a rod-shaped device body 101. Within the device body 101, the device 100 comprises a power supply (not shown), for example a lithium ion battery, and an electric circuitry (not shown) for controlling the operation of the device 100, in particular for controlling the heating process.

At a proximal end 103 of the rod-shaped device body 101, the device 100 comprises a protruding cylindrical receiving sleeve 102 extending coaxially to a longitudinal axis of the rod-shaped device body 101. The cylindrical receiving sleeve 102 is open-ended at the proximal end 103 of device 100, thus allowing the interior of the sleeve to be readily accessible.

Within the receiving sleeve 102, that is, within its interior, the cylindrical receiving sleeve 102 comprises an inner receiving zone 110 for receiving a first aerosol-forming substrate 211. Likewise, the cylindrical receiving sleeve 102 comprises an outer receiving zone 120 extending across at least a portion of an outer circumferential periphery of the receiving sleeve 102 for receiving a second aerosol-forming substrate 221. The cylindrical inner receiving zone 110 extends across the entire interior volume of the receiving sleeve 102. Advantageously, this provides a maximum receiving capacity for the first aerosol-forming substrate 211. The outer receiving zone 120 axially extends along the entire axial length extension of the receiving sleeve 102. In the radial direction with regard to the longitudinal axis of the device 100, the outer receiving zone 120 extends between an outer cross-sectional profile of the receiving sleeve 102 and a maximum outer cross-sectional profile of the overall rod-shaped device body 101 (dashed-dotted line). Accordingly, the second receiving 120 is of a sleeve shape or a tubular shape. The inner receiving zone 110 and the outer receiving zone 120 substantially overlap along the length extension of the receiving sleeve 102. That is, the outer receiving zone 120 substantially surrounds the inner receiving zone 110 entirely. Advantageously, this nested arrangement of the inner receiving zone 110 and the outer receiving zone 120 provides a very compact design of the aerosol-generating device 100.

To enable the aerosol-generating article 200 for use with aerosol-generating device 100, the configuration of the article 200 is complementary to the aerosol-generating device 100, in particular complementary to the receiving sleeve 102. Accordingly, the aerosol-generating article 200 according to both embodiments as shown in FIG. 1 and FIGS. 2 to 4 comprises an inner substrate core 210 and an outer substrate sleeve 220. The outer substrate core 220 surrounds the inner substrate core 210 at a distance such as to form a circumferential, in particular annular slot 202 between the inner core 210 and the outer sleeve 220. The circumferential slot 202 is open or accessible at a distal end 204 of the article 200 such as to allow the receiving sleeve 102 of the device 100 to readily engage into the circumferential slot 202 upon assembling the article 200 and the device 100.

According to the invention, the substrate core 210 contains or is adapted for containing a first aerosol-forming substrate 211 whereas the substrate sleeve 220 contains or is adapted for containing a second aerosol-forming substrate 221. In the present embodiments as shown in FIG. 1 and FIGS. 2 to 4, the substrate core 210 includes a solid tobacco-containing aerosol-forming substrate 211. In particular, the substrate core 210 comprises a solid tobacco-containing aerosol-forming substrate 211. Furthermore, the substrate core 210 comprises a support element 212, an aerosol-cooling element 216 and a filter element 217 as described above which are arranged sequentially to the substrate 211 downstream towards a proximal end of the substrate core 210. The substrate 211, the support element 212, the aerosol-cooling element 216 and the filter element 217 are surrounded by a paper wrapper 213 which forms the outer circumferential surface 214 of the substrate core 210. The wrapper preferably is fluid permeable such as to allow vaporized aerosol-forming substrate to be readily released from the substrate core 210.

In contrast to the first aerosol-forming substrate 211, the second aerosol-forming substrate 221 according to the present embodiments is a liquid aerosol-forming substrate 221. For this, the substrate sleeve 220 comprises a liquid retention material that is adapted for containing a liquid aerosol-forming substrate. For example, the liquid retention material may be an open-porous ceramic material capable of being soaked by a liquid aerosol-forming substrate. In the present embodiments, the substrate sleeve 120 comprises a liquid retention material that is soaked by aerosol-forming liquid comprising at least one liquid aerosol former, for example propylene glycol, and a liquid flavor substance, in particular a liquid tobacco flavor substance. The substrate sleeve may comprise a cover at least on an outer circumferential surface of the liquid retention material which advantageously forms a portion of an outer surface of the aerosol-generating article. In particular, the cover may at least partially encapsulate the liquid retention material.

As can be particularly seen in FIG. 2 and FIG. 3, the substrate sleeve 220 and the substrate core are each attached to one side of a disc-shaped support element 206. At the proximal end 203 of the art, the article 200 comprises a mouthpiece 207 attached to the other side of the support element 206. The mouthpiece 207 is adapted to be placed into a user's mouth in order to directly inhale an aerosol generated from at least one of the first or the second aerosol-forming substrate 211, 221. For this, the mouthpiece 207 comprises a common air outlet 208. To allow aerosol generated from at least one of the first or the second aerosol-forming substrate 211, 221 towards the air outlet 208 in the mouthpiece 207, the support element 206 is fluid permeable. For example, the support element 206 may comprise at least one airflow aperture.

In the present embodiments, the substrate core 210 is removably attached to the support element 206. Thus, upon consumption of the first aerosol-forming substrate 211, the rod-shaped substrate core 210 may be entirety removed and replaced by a new one, that is, by a new substrate core 210 containing fresh aerosol-forming substrate. Likewise, the substrate sleeve 220, in particular the liquid retention material, may be adapted to be refilled with liquid aerosol-forming substrate. Advantageously, this allows for a multiple use of the aerosol-generating article 200, in particular of the mouthpiece 207, the support element 206 and the substrate sleeve 210.

The substrate sleeve 220 and the rod-shaped substrate core 210 are coaxially arranged with regard to a longitudinal axis of the article 200. The axial length extension of the substrate sleeve 220 substantially is equal to the axial length extension of the substrate core 210. That is, the outer substrate sleeve 220 substantially surrounds the substrate core 210 entirely, thus providing a nested arrangement corresponding to the nested arrangement of the inner receiving zone 110 and the outer receiving zone 120 of the device 100. However, at the distal end 206 of the article 200, substrate sleeve 220 is axially recessed as compared to the substrate core 210. Advantageously, this may provide at least a lateral (second) air inlet 129 in fluid communication with a second airflow passage 128 passing along the inner circumferential surface of the substrate sleeve 210.

Upon assembling the article 200 and the device 100, that is, upon inserting the receiving sleeve 102 of the device 100 into the circumferential slot 202 of the article 100 as shown in FIG. 2, the inner substrate core 210 containing the solid first aerosol-forming substrate 211 is arranged with the inner receiving zone 110 of the receiving sleeve 102. Likewise, the substrate sleeve 220 containing the liquid second aerosol-forming substrate 221 is arranged within the outer receiving zone 120 of the receiving sleeve 102. As a result, the first and second aerosol-forming substrate 211, 221 are advantageously received within the aerosol-generating device 100 in a nested and thus very compact arrangement.

The aerosol-generating systems 1 according to FIG. 1 and FIGS. 2 to 4, respectively, are inductively heated systems. That is, the aerosol-generating device 100 is configured for inductive heating of at least one of the first and the second aerosol-forming substrate 211, 221. In particular, the aerosol-generating device 100 is configured for selectively heating at least one of the two substrates 211, 221. That is, the device 100 is configured for heating only one of the first or the second aerosol-forming substrate 211, 221 at a time, or for simultaneously and preferably also individually heating both, the first and the second aerosol-forming substrate 211, 221, at the same time.

Due to this selective heatability of the first and second aerosol-forming substrate 211, 221 the aerosol-generating device 100 advantageously enables a user to selectively consume either one of the first or the second substrate or a combination of both substrates at the same time which greatly enhances the user experience. Furthermore, allowing two aerosol-forming substrates 211, 221 to be consumed either simultaneously or successively or alternatingly enables a user to vary, in particular to significantly extend the duration of a user experience.

For this, the aerosol-generating device 100 comprises an inductive heater including a first and second induction source for inductively heating a corresponding first and second susceptor 215, 225 within the article 200. Alternatively, at least one of the first or second susceptor 215, 225, preferably the first susceptor 215, may be integral part of the device 100.

The first induction source comprises a first inductor coil 115 which is operatively connected to a first AC generator that is part of the electric circuitry of the device 100. Likewise, the second induction source comprises a second inductor coil 125 which is operatively connected to a second AC generator that is also part of the electric circuitry of the device 100. Having separate first and second induction sources proves particularly advantageous for heating the first and second aerosol-forming substrate 211, 221 individually. In particular, this allows the first and second aerosol-forming substrate 211, 221 to be heated differently, in particular with different heating powers, for different heating periods, and/or in different heating modes, such as in a pulsed or a continuous heating mode.

In the embodiments, each one of the first and second inductor coil 115, 125 is a helical coil arranged between an inner and an outer circumferential surface of the receiving sleeve 102. An axial length of the first inductor coil 115 is larger than an axial length of the second inductor coil 115. Furthermore, the first and second inductor coils 115, 125 are arranged at different axial positions with regard to the longitudinal axis of the device body 101 in order to reduce interference effects between the inductive heating of the first and the second aerosol-forming substrate 211, 221.

The first and the second susceptors 215, 225 are arranged at corresponding axial positions within the article 200 such that upon assembling the article 200 with the device 100, the first susceptor 215 is arranged at the same axial position next to the first inductor coil 115, and the second susceptor 225 is arranged at the same axial position next to the second inductor coil 125. Advantageously, this enhances the heating efficiency. Moreover, an axial length extension of the first susceptor 215 substantially corresponds to an axial length extension of the first inductor coil 115. Likewise, an axial length extension of the second susceptor 225 substantially corresponds to an axial length extension of the second inductor coil 125. This also proves advantageous with regard to the heating efficiency.

In the present embodiments, the first susceptor 215 is a blade made of ferromagnetic stainless steel which is arranged at a distal end 204 of the article 200 with in the substrate core 210 in direct contact with the first aerosol-forming substrate 211. In particular, the first susceptor 215 is arranged coaxially to a longitudinal center axis of the substrate core 210 which proves advantageous with regard to a homogenous heating of the first aerosol-forming substrate 211. As mentioned above, the first susceptor 215 may be alternatively integral part of the device 100.

The second susceptor 225 is a mesh sleeve also made of ferromagnetic stainless steel. The mesh sleeve is circumferentially arranged on or close to a proximal portion of the inner circumferential surface of the substrate sleeve 220. The second susceptor 225 is in contact with a portion of the liquid retention material which contains the liquid second aerosol-forming substrate 221. Thus, when heating the second susceptor 225, liquid aerosol-forming substrate 221 within the liquid retention material is evaporated in a certain heating zone in proximity of the second susceptor 225. Due to capillary effects in the liquid retention material, liquid aerosol-forming substrate 221 is continuously drawn into the heating zone.

As can be seen particularly in FIG. 2, the aerosol-generating system 1 comprises two separate airflow passages 118, 128 for the first and second aerosol-forming substrate. A first airflow passage 118 extends from one or more first air inlets 119 in a distal portion of the device body 101 through the first receiving zone 110 towards the proximal end 103 of the device 100. Thus, upon assembling the device 100 with the article 200, the first airflow passage 118 passes through the substrate core 210, in particular through the first aerosol-forming substrate 211, further into the mouthpiece 207 towards the outlet 208 at the proximal end 203 of the article 200. A second airflow passage 128 extends from one or more lateral second air inlets 129 at the distal end of the receiving sleeve 102 through the second receiving zone 110 towards the proximal end 103 of the device 100. When the device 100 is assembled with the article 200, the second airflow passage 118 thus passes through a circumferential free space volume between the inner circumferential surface of the substrate sleeve 220 and the outer circumferential surface of the receiving sleeve 102, and further into the mouthpiece 207 towards the outlet 208 at the proximal end 203 of the article 200. The separation of the first and the second airflow passage 118, 128 is substantially due to the physical separation of the first and second receiving zones 110, 120 provided by the receiving sleeve 102. In use, the physical separation facilitates to selectively or solely consume only one of the two substrates 211, 221.

Instead of an inductive heater, the aerosol-generating device 100 may alternatively comprise a resistive heater or a hybrid heater for heating the first and second aerosol-forming substrate 211, 221. With regard to the hybrid heater, the device may in particular comprise a resistive heater for heating the first aerosol-forming substrate within the inner receiving zone and an inductive heater for heating the second aerosol-forming substrate within the outer receiving zone. The resistive heater may comprise a resistive heating element, for example a resistive heating blade as described above, which preferably is integral part of the device. In contrast, the inductive heater may comprise an inductor coil for interaction with a susceptor that preferably is integral part of the article. Advantageously, the inductor coil is arranged on an outer circumferential surface of the receiving sleeve or between an inner and an outer circumferential surface of the receiving sleeve.

In the following, the operation principle of the aerosol-generating system 1 according to the invention will be described by way of an example. Upon assembling an article 200 with the device 100, a user may select an operation mode of the device, that is, the user may select whether to consume either one of the first or the second substrate 211, 221 or a combination of both substrates at the same time. The specific operation mode may be selected for example by pressing an activation button 109 on the device body 101 as shown in FIG. 1. The heating process itself may be (de-) activated manually, for example also by way of the activation button 109. For the given example, it is assumed that both substrates 211, 221 are to be consumed simultaneously. Accordingly, upon activation of the heating process, both AC generators provide a high frequency oscillating current to the first and second inductor coil 115, 125, respectively. Consequently, each of the first and second inductor coil 115, 125 generates an alternating magnetic field which is sensed by the first and second susceptor 215, 225, respectively. As a result, each of the two susceptors 215, 225 heats up until it reaches an operation temperature sufficient to vaporize the respective aerosol-forming substrate 211, 221. After reaching the operation temperature—which may be indicated to the user, for example by way an indicator lamp, such as a LED (light emitting diode)—the user may puff on the mouthpiece 207 to draw air via the first and second air inlets 119, 129 into the first and second airflow passages 118, 128 and further through the outlet 208 of the mouthpiece 207 into the user's mouth. Thus, vaporized material generated within the substrate core 210 and the substrate sleeve 20 is entrained in the air flowing through the first and second airflow passage 118, 128. There, the respective vaporized material cools to form an aerosol along its way towards the mouthpiece 207 before escaping through the outlet 208. Accordingly, a user not only gets the tobacco experience of the heated solid first aerosol-forming substrate 211 or only the flavor experience of the heated aerosol-forming liquid 221, but the combination of the aerosol formed by heating the solid aerosol-forming substrate and the aerosol formed by evaporated aerosol-forming liquid.

The invention claimed is:

1. Aerosol-generating device for use with a plurality of aerosol-forming substrates, the device comprising:

a receiving sleeve comprising an inner receiving zone within the receiving sleeve for receiving at least a first aerosol-forming substrate, and an outer receiving zone extending across at least a portion of an outer circumferential periphery of the receiving sleeve for receiving at least a second aerosol-forming substrate; and an electrical heater for heating at least one of the first aerosol-forming substrate and the second aerosol-forming substrate when being received in the first and the second receiving zone, respectively, wherein the electrical heater is configured for heating each one of the first and the second aerosol-forming substrate individually.

2. The aerosol-generating device according to claim 1, wherein the inner receiving zone is rod-shaped and wherein the outer receiving zone is sleeve-shaped.

3. The aerosol-generating device according to claim 1, wherein the electrical heater is an inductive heater comprising at least one of a first inductor coil or a second inductor coil for heating the first or the second aerosol-forming substrate, respectively.

4. The aerosol-generating article according to claim 3, wherein the first inductor coil and the second inductor coil are arranged at different axial positions with regard to a longitudinal axis of the receiving sleeve.

5. The aerosol-generating device according to claim 3, wherein the inductive heater comprises at least one of a first susceptor or a second susceptor to interact with the first or second inductor coil, respectively.

6. The aerosol-generating device according to claim 1, wherein the electrical heater is a resistive heater comprising at least one of a first resistive heating element or a second resistive heating element for heating the first or the second aerosol-forming substrate, respectively.

7. The aerosol-generating device according to claim 1, wherein the electrical heater is a hybrid heater comprising a resistive heater for heating one of the first or the second aerosol-forming substrate and an inductive heater for heating the respective other one of the first or the second aerosol-forming substrate.

8. The aerosol-generating device according to claim 1, further comprising a first airflow passage passing through the inner receiving zone and a second airflow passage passing through the outer receiving zone.

9. Aerosol-generating article for use with an aerosol-generating device, the article comprising an inner substrate core and an outer substrate sleeve surrounding the inner substrate core at a distance such as to form a circumferential slot between the inner substrate core and the outer substrate sleeve, the circumferential slot being open at a distal end of the article, wherein the inner substrate core contains or is adapted for containing at least a first aerosol-forming substrate and the outer substrate sleeve contains or is adapted for containing at least a second aerosol-forming substrate.

10. The aerosol-generating article according to claim 9, wherein at least one of the substrate core or the substrate sleeve comprises a liquid retention material or a tank containing or being adapted for containing a liquid aerosol-forming substrate.

11. The aerosol-generating article according to claim 9, further comprising at least one of a first susceptor arranged on an outer circumferential surface of the substrate core or within the substrate core, or a second susceptor arranged on an inner surface of the substrate sleeve or within the substrate sleeve.

12. The aerosol-generating article according to claim 11, wherein the first susceptor and the second susceptor are arranged at different axial positions with regard to a longitudinal axis of the substrate sleeve.

13. The aerosol-generating article according to claim 9, further comprising a mouthpiece arranged at a proximal end of the article.

14. Aerosol-generating system comprising an aerosol-generating device accordingly to claim 1 and an aerosol-generating article for use with the aerosol-generating device, the article comprising an inner substrate core and an outer substrate sleeve surrounding the inner substrate core at a distance such as to form a circumferential slot between the inner core and the outer sleeve, the circumferential slot being open at a distal end of the article, wherein the substrate core contains or is adapted for containing at least a first aerosol-forming substrate and the substrate sleeve contains or is adapted for containing at least a second aerosol-forming substrate.

15. The aerosol-generating system according to claim 14, wherein an inner cross-sectional profile of the substrate sleeve of the article is larger than an outer cross-sectional profile of the receiving sleeve of the device.

* * * * *